US006639390B2

(12) United States Patent
Perez et al.

(10) Patent No.: US 6,639,390 B2
(45) Date of Patent: Oct. 28, 2003

(54) PROTECTION CIRCUIT FOR MILLER COMPENSATED VOLTAGE REGULATORS

(75) Inventors: Raul A. Perez, Richardson, TX (US); Baoson Nguyen, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 10 days.

(21) Appl. No.: 10/113,081

(22) Filed: Apr. 1, 2002

(65) Prior Publication Data

US 2003/0184268 A1 Oct. 2, 2003

(51) Int. Cl.[7] ..... G05F 1/40; G05F 1/571

(52) U.S. Cl. ..... 323/282; 323/276

(58) Field of Search ..... 323/280, 282, 323/284, 313, 315, 276; 327/382, 538

(56) References Cited

U.S. PATENT DOCUMENTS 4,908,566 A * 3/1990 Tesch ..... 323/280
5,850,139 A * 12/1998 Edwards ..... 323/280
5,867,015 A * 2/1999 Corsi et al. ..... 323/316
6,084,475 A * 7/2000 Rincon-Mora ..... 330/255
6,188,211 B1 * 2/2001 Rincon-Mora et al. ..... 323/280
6,246,221 B1 * 6/2001 Xi ..... 323/280
6,278,320 B1 * 8/2001 Vu ..... 327/539
6,300,749 B1 * 10/2001 Castelli et al. ..... 323/273
6,304,131 B1 * 10/2001 Huggins et al. ..... 327/538
6,448,750 B1 * 9/2002 Shor et al. ..... 323/282

* cited by examiner

*Primary Examiner*—Adolf D. Berhane
(74) *Attorney, Agent, or Firm*—J. Dennis Moore; W. James Brady, III; Frederick J. Telecky, Jr.

(57) ABSTRACT

A capacitively compensated voltage regulator, adapted to be supplied with power from a voltage supply, and having an input port and an output port. The voltage regulator includes a voltage regulation circuit responsive to a reference voltage at the input port to provide a regulated voltage at the output port, including a compensation capacitor having a plate connected to a node internal to the voltage regulator, and including a current source coupled between the voltage supply and the internal node. The voltage regulator also includes a low power control circuit responsive to a low power command signal. The low power control circuit includes a delay circuit responsive to a transition in the level of the low power command signal to generate a low power control signal for a predetermined time period after said transition, and also a bypass circuit coupled between the internal node and the voltage supply, responsive to the low power control signal to provide, for the predetermined time period, a current higher than the current provided by the current source, and otherwise to provide substantially no current. By the action of the standby control circuit a voltage overshoot or surge at the output port of the voltage regulator circuit is avoided.

5 Claims, 1 Drawing Sheet

PROTECTION CIRCUIT FOR MILLER COMPENSATED VOLTAGE REGULATORS

TECHNICAL FIELD OF THE INVENTION

This invention relates to capacitively compensated voltage regulators, such as Miller compensated voltage regulators, and more particularly relates to a capacitively compensated voltage regulator having improved characteristics in the transition from standby mode to normal mode.

BACKGROUND OF THE INVENTION

Electronic circuits are increasingly used in portable and mobile applications in which low power consumption is highly desirable in order to avoid the necessity of large and bulky battery supplies. Such applications include wireless phones, personal pagers, personal digital assistants, etc.

One way of achieving such low power consumption is to provide a low power mode, which can be a so-called Standby, or, Sleep, mode for the electronic circuit. Standby mode is provided as a general matter by including a module that monitors the use of the circuit and that signals the circuit to change from a normal mode to a Standby mode when the circuit has not been called upon for use after a predetermined time period, or which changes the circuit from a normal mode to a low power mode, if that is all that is required. In response, the circuit changes to a reduced power configuration using a variety of well-known power saving techniques. When the module detects that the circuit is required for use again, the module signals the circuit to return to normal mode.

Capacitively compensated voltage regulators are in widespread use for providing a controlled voltage in a stable circuit. One such circuit finding increased use in low power applications is the Miller compensated low drop-out ("LDO") voltage regulator. Such voltage regulators have a small difference between the input voltage and the regulated output voltage, and, because of their compensation provide desired circuit stability. An example of a Miller compensated LDO voltage regulator is described in U.S. Pat. No. 6,304,131, entitled "High power supply ripple rejection internally compensated low drop-out voltage regulator using PMOS pass device," which issued on Oct. 16, 2001, to Mark Wayne Huggins et al., and which is commonly assigned.

However, when attempting to provide a low power mode to capacitively compensated voltage regulators, a problem arises in that in the transition from low power mode to normal mode the compensation capacitor transiently loads the node at which it is located. This problem arises in many capacitively compensated voltage regulators. An example of this problem can be understood by reference to FIG. 1, which shows a prior art Miller compensated LDO voltage regulator. In this circuit, being provided with a voltage source $V_{DD}$, a bandgap reference voltage BGR is applied to the input, which is connected to the gate of PMOS transistor MP1, and an output voltage is provided at the output node OUT. A load, which may have a capacitive component $C_L$ and a resistive component $R_L$, can be connected between OUT and circuit ground GND. The various components, including as PMOS transistors MP1–MP4, NMOS transistors MN1 and MN2, current sources and sinks I1–I6, which may, for example, be current mirrors reflecting a current that is provided by external circuitry, and capacitor C1, operate according to well known principles to provide a regulated voltage corresponding to the input voltage BGR at OUT.

The Miller, or compensation, capacitor is C1, provided in a feedback path from the output node OUT to node A. The equivalent capacitance at node A is approximately $$Ceq=C1\cdot(1-Av), \qquad \text{Equation (1)}$$

where Av is the voltage gain between node A and the output, which is a negative quantity.

For the circuit in FIG. 1, in the transition from standby mode to normal mode the DC bias voltage at node A increases rapidly, because the current passing through the transistors changes immediately when the circuit changes from normal mode to standby mode. This causes Miller capacitor C1 to charge to the new DC bias voltage. Changing the voltage at node A very rapidly requires a large amount of current for a short time period. When the common gate transistor MN2 tries to source all the current needed for this, the voltage at node B collapses. Because current sources cannot drive loads, the amplifier reacts to correct the error.

The buffer transistor MP3 passes this instantaneous voltage drop to the gate of the pass device MP4. In an LDO such as is shown in FIG. 1 the pass device such as MP4 can typically conduct from a few to hundreds of milliamps. This instantaneous surge of current causes a charge build-up in the output when there is no load connected, or where there is a small capacitance connected to the output. In fact, the amount of voltage change at the output created by this surge current can be approximated by the following equation:

$$\Delta V=(I\text{surge}\times\Delta T)/C\text{load}, \qquad \text{Equation (2)}$$

where Isurge is the surge current, ΔT is the interval of the surge and Cload is the capacitance seen at the output.

Solutions to this problem in capacitively compensated voltage regulators are problematic. For example, in Miller compensated LDO voltage regulators the maximum size of the output capacitor is restricted, since the second pole of the system is determined by the size of this capacitor, and too large an output capacitance degrades the phase margin of the LDO. Therefore, a designer cannot simply increase the output capacitor size to reduce this change in output voltage until the specifications have been met. Furthermore, increasing the size of the output capacitor can also result in an increase in the cost of the product including the circuit. However, as mentioned above, while of particular concern in Miller compensated LDOs, numerous architectures and implementations are known to provide capacitively compensated voltage regulation, and have the same problem of overshoot.

Therefore, it would be desirable to have a capacitively compensated voltage regulator circuit that avoids the problems discussed above.

SUMMARY OF THE INVENTION

In accordance with the present invention there is provided a capacitively compensated voltage regulator, adapted to be supplied with power from a voltage supply, and having an input port and an output port. The voltage regulator includes a voltage regulation circuit responsive to a reference voltage at the input port to provide a regulated voltage at the output port, including a compensation capacitor having a plate connected to a node internal to the voltage regulator, and including a current source coupled between the voltage supply and the internal node. The voltage regulator also includes a low power control circuit responsive to a low power command signal. The low power control circuit includes a delay circuit responsive to a transition in the level of the low power command signal to generate a low power control signal for a predetermined time period after said transition, and also a bypass circuit coupled between the internal node and the voltage supply, responsive to the low power control signal to provide, for the predetermined time period, a current higher than the current provided by the current source, and otherwise to provide substantially no current. By the action of the standby control circuit a voltage overshoot or surge at the output port of the voltage regulator circuit is avoided.

These and other features of the invention will be apparent to those skilled in the art from the following detailed description of the invention, taken together with the accompanying drawings.

DETAILED DESCRIPTION OF THE PREFERRED EMBODIMENT

Figure 1:
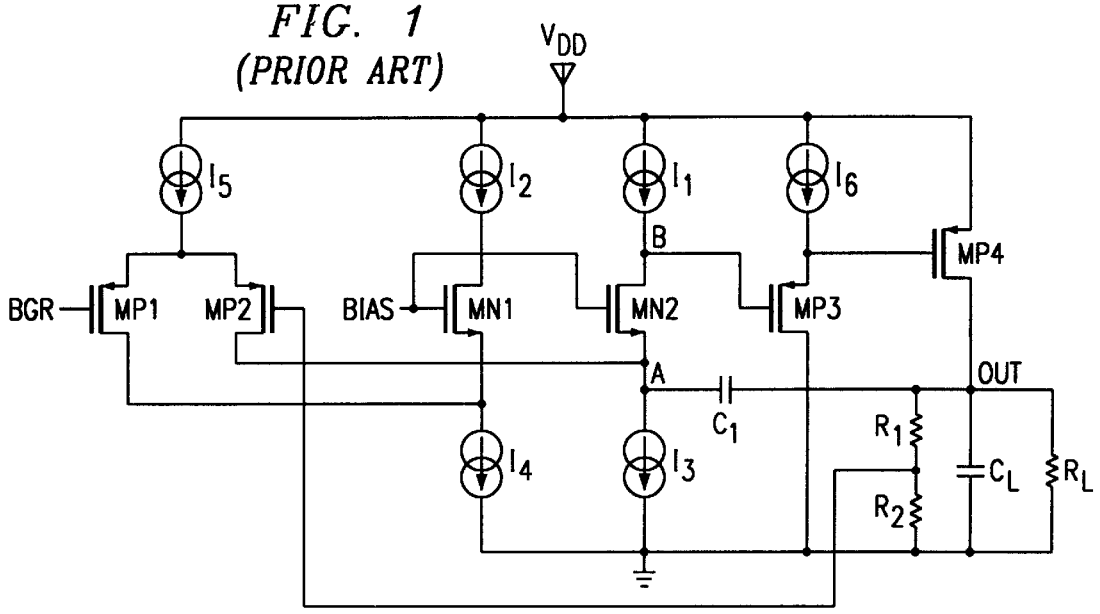
FIG. 1 (PRIOR ART)
FIG. 1 is a circuit diagram of a prior art Miller compensated low drop out voltage regulator.
Figure 2:
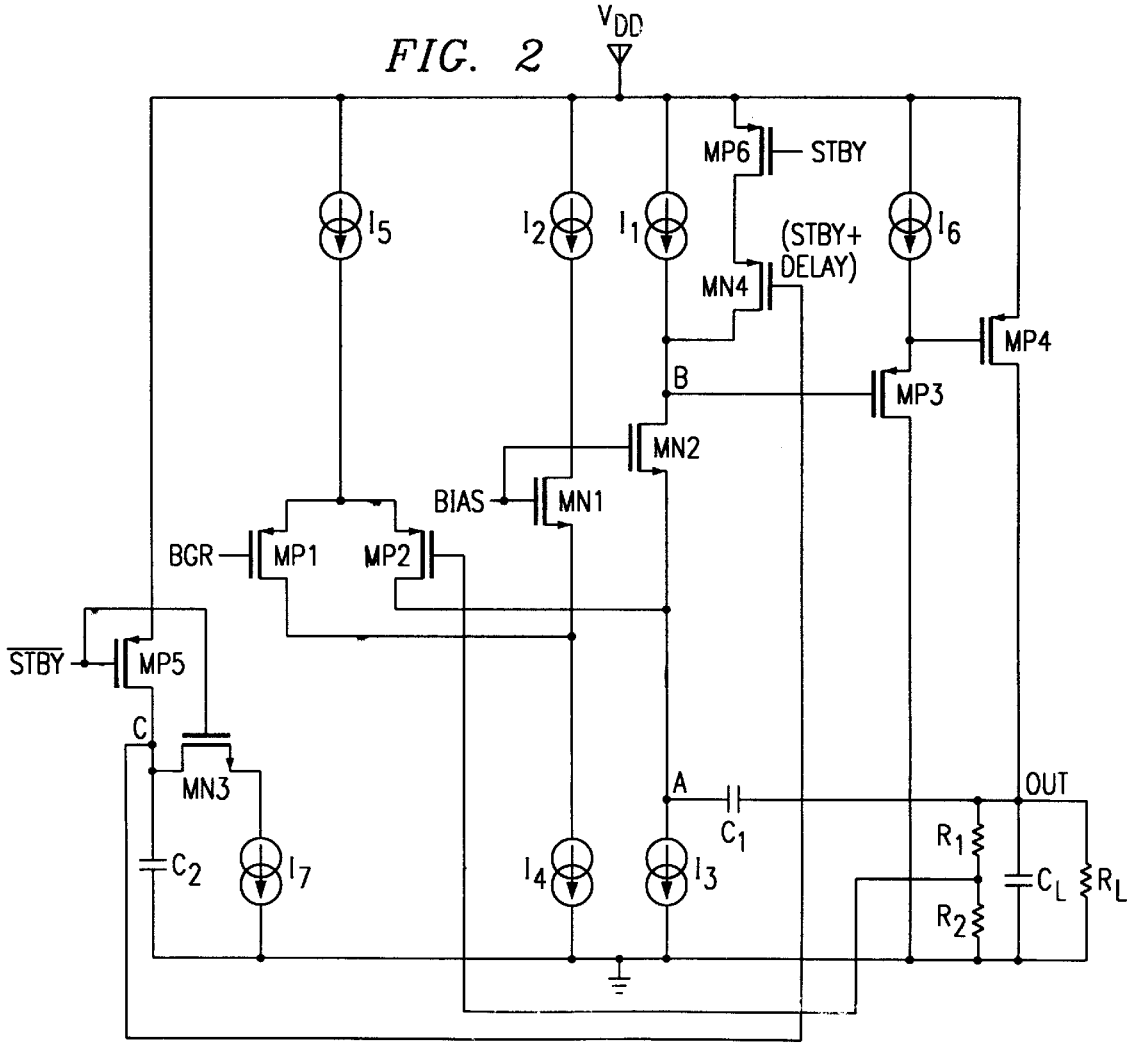
FIG. 2 is a circuit diagram of a Miller compensated low drop out voltage regulator comprising the preferred embodiment of the present invention.

FIG. 2 shows the preferred embodiment of the invention. The circuit of FIG. 2 is a Miller compensated LDO voltage regulator like that of FIG. 1, but having added thereto circuitry that provides a solution to the above-described problems using the principles of the invention. Circuit components that are the same as in FIG. 1 have the same designation as in FIG. 1, and operate the same as described above in the Background section, except as they are influenced by the added circuitry, which is described below.

As mentioned above, various architectures and implementations are available to provide capacitively compensated voltage regulation, as is known in the art. The principles of the invention, as set forth herein, are applicable to a wide variety of such voltage regulators to arrive at implementations and embodiments of the invention for such voltage regulators, as will be readily apparent to practitioners of ordinary skill in this art area, once the principles of the invention, as set forth herein, are understood. All such implementations are considered within the scope of the invention.

Returning to FIG. 2, in general, the inventive added circuitry causes a bypass of the current source feeding NMOS transistor MN2 with a low impedance path to $V_{DD}$ for a short period of time after the change of quiescent current has occurred as a result of the mode change from standby to normal. The added circuitry is on only for that short period of time. Thus, the undesirable current surge described above is avoided, but the normal operation of the LDO voltage regulator circuit is not interfered with.

Referring again to FIG. 2, the standby mode is controlled by the signal STBY. Thus, when STBY is at level 1 standby mode is forced. Conversely, when STBY is at level 0 the circuitry is allowed to return to normal mode. The inverse of STBY, represented as $\overline{\text{STBY}}$, is applied to the gate of PMOS transistor MP5. During standby mode the signal $\overline{\text{STBY}}$ is at level 0, causing transistor MP5 to be in an on state and transistor NMOS transistor MN3 to be in an off state. In this condition, capacitor C2 charges fully. When the circuit is changed from standby mode to normal mode, and thus the signal $\overline{\text{STBY}}$ changes from level 0 to level 1, transistor MP5 turns off and transistor MN3 turns on. This connects capacitor C2 to current sink I7, and capacitor C2 begins discharging at a rate described by:

$$\Delta T=(C2\times\Delta V)/I\text{sink}, \qquad \text{Equation (3)}$$

where ΔT is a time interval during the discharge, ΔV is the change in voltage across capacitor C2 during the time interval ΔT and Isink is the magnitude of current flow through current sink I7. Thus, node C, the node at which the drain of MP5 connects to a plate of capacitor C2, can be considered a delay node. This delay node is connected to the gate of an NMOS transistor MN4, for reasons described below. Note for now, however, that transistor MP5 was chosen to be a PMOS device, in order to obtain a rail-to-rail voltage at node C, so as to ensure that transistor MN4 will have enough voltage to be turned on sufficiently, even at the limits of process tolerances, and so in this configuration a PMOS device for MP5 is considered preferred. Note also in this regard, that transistor MN4 is preferably a low Vt device.

It can be seen that the time that the voltage at node C takes to decrease sufficiently to turn transistor MN4 off can be controlled by suitable selection of the size of capacitor C2 and the magnitude of current through current sink I7.

Now, during standby mode the voltage at node C is high, because capacitor C2 is fully charged, as described above. Thus, transistor MN4 is in an on state during this mode. Since the signal STBY is at level 1 during standby mode, PMOS transistor MP6 is in an off state. Thus, the circuit branch comprising transistors MP6 and MN4 tends to draw no current, which is desirable. However, when the circuit is changed from standby mode to normal mode, and thus the signal STBY changes from level 1 to level 0, transistor MP6 turns on. Because the voltage at node C decreases only as capacitor C2 discharges, the voltage at the gate of transistor MN4 remains sufficiently high to maintain transistor MN4 in an on state for the time period described above. Once the voltage at node C decreases sufficiently, transistor MN4 turns off. Thus, for such time period both transistors MP6 and MN4 are in an on state, and the desired bypass of current source I1 for a controlled period of time is effected. In addition, note that, except for such controlled period of time, transistors MP6 and MN4 are out of phase and thus tend to draw no current, which is desirable.

Thus, it can be seen that transistor MN4 has its maximum gate to source voltage VGS at the time when NMOS transistor MN2 is attempting to draw a short interval surge of current to charge the Miller capacitor C1 during the transition from standby mode to normal mode, but the circuit branch including transistor MN4 only turns on to pass current during such transition.

It is worth noting that the use of a PMOS buffer (MP3) is considered preferred in the above-described implementation. If a designer were to use an NMOS buffer, the problem solved by the invention would actually be ameliorated. This is because the NMOS buffer would tend not to transfer the voltage surge associated with the current surge to charge the compensation capacitor. However, using an NMOS buffer to drive a PMOS pass device gives rise to other problems. For example, to be able to turn off the pass device completely the gate voltage has to be very close to the upper rail voltage ($V_{DD}$), and the sub-threshold conduction of such a large device is considerable. Such conduction could result in the output capacitor considerably beyond specified limitations under no load conditions.

As a final matter, the inventive solution, as exemplified in the preferred embodiment described in detail above, requires a small number of components. Furthermore, the delay capacitor, C2 in FIG. 2, can be chosen to be as small as 1 pF and the circuit can still provide sufficient protection, since the maximum current surge to charge the Miller capacitor happens substantially at the initial instant, when transistor MN4 has its maximum VGS.

Although the present invention and its advantages have been described in detail, it should be understood that various changes, substitutions and alterations can be made herein without departing from the spirit and scope of the invention as defined by the appended claims. For example, while the invention has been described above with respect to its preferred embodiment, the same inventive principles can be applied to other capacitively compensated voltage regulators which, in a transition from a low power mode to normal mode operate to rapidly charge up their compensation capacitor and thus produce undesirable voltage surges at their outputs. By providing circuitry to effect the controlled-time bypass to the voltage supply of the current source that would thus charge their compensation capacitor, during such time as charge-up is effected, the undesirable voltage surges an be reduced to an acceptable level.

What is claimed is:

1. A capacitively compensated voltage regulator, adapted to be supplied with power from a voltage supply, and having an input port and an output port, comprising:

a voltage regulation circuit responsive to a reference voltage at the input port to provide a regulated voltage at the output port, including a compensation capacitor having a plate connected to a node internal to the voltage regulator, and including a current source coupled between the voltage supply and the internal node; and a low power control circuit responsive to a low power command signal, comprising a delay circuit responsive to a transition in the level of the low power command signal to generate a low power control signal for a predetermined time period after said transition, and a bypass circuit coupled between the internal node and the voltage supply, responsive to the low power control signal to provide, for the predetermined time period, a current higher than the current provided by the current source, and otherwise to provide substantially no current.

2. A capacitively compensated voltage regulator as in claim 1 wherein said voltage regulation circuit comprises:

a first current source coupled to the voltage supply;

a first and a second PMOS transistor together comprising a differential input pair of transistors connected to said first current source and to each other at their drains, the gate of said first PMOS transistor being adapted to receive a reference voltage and the gate of said second PMOS transistor being connected to feedback circuitry connected to the output port;

a third PMOS transistor connected between the voltage supply and the output port by its drain and source; and an amplifier circuit coupled to said differential input pair of transistors and providing a control voltage to the gate of the third PMOS transistor to regulate the voltage at the output port.

3. A capacitively compensated voltage regulator as in claim 2 wherein said amplifier circuit comprises:

second, third and fourth current sources coupled to the voltage supply to provide second, third and fourth currents, respectively;

first and second current sinks coupled to a ground and sinking fifth and sixth currents, respectively;

a first NMOS transistor connected by its drain and source between said second current source and said first current sink, adapted to receive at its gate a bias voltage, and having its source connected to the drain of said first PMOS transistor;

a second NMOS transistor connected by its drain and source between said third current source and said second current sink, adapted to receive at its gate said bias voltage, and having its source connected to the drain of said second PMOS transistor;

a fourth PMOS transistor connected by its drain and source between said fourth current source and said ground, having its gate connected to the drain of said second NMOS transistor, and having its source connected to the gate of said third PMOS transistor;

said compensation capacitor being connected between the output port and the source of said second NMOS transistor.

4. A capacitively compensated voltage regulator as in claim 3 wherein said delay circuit comprises:

a fifth PMOS transistor having a source connected to the voltage supply and having a gate adapted to receive the inverse of said low power command signal;

a third current sink sinking a seventh current; and a third NMOS transistor having a source connected to said third current sink, having a gate adapted to receive the inverse of said low power command signal, and having a drain connected to a drain of said fifth PMOS transistor, said common connection node of the drains of said third NMOS transistor and said fifth PMOS transistor providing said low power control signal.

5. A capacitively compensated voltage regulator as in claim 4 wherein said bypass circuit comprises:

a sixth PMOS transistor having a source connected to the voltage supply and having a gate adapted to receive said low power command signal; and a fourth NMOS transistor having a drain connected to a drain of said sixth PMOS transistor, having a gate connected to said common connection node of the drains of said third NMOS transistor and said fifth PMOS transistor, and having a source connected to said drain of said second NMOS transistor.

* * * * *